US011279150B2

(12) United States Patent
Veis et al.

(10) Patent No.: US 11,279,150 B2
(45) Date of Patent: Mar. 22, 2022

(54) SUCTION ARRAY LAYOUTS

(71) Applicant: HP SCITEX LTD., Netanya (IL)

(72) Inventors: Alex Veis, Kadima (IL); Eviatar Halevi, Netanya (IL)

(73) Assignee: HP SCITEX LTD., Netanya (IL)

( * ) Notice: Subject to any disclaimer, the term of this patent is extended or adjusted under 35 U.S.C. 154(b) by 737 days.

(21) Appl. No.: 15/918,943

(22) Filed: Mar. 12, 2018

(65) Prior Publication Data

US 2018/0297378 A1 Oct. 18, 2018

(30) Foreign Application Priority Data

Apr. 18, 2017 (EP) ..... 17166930

(51) Int. Cl.

| | |
|---|---|
| ***B65H 5/22*** | (2006.01) |
| ***B41J 11/00*** | (2006.01) |
| ***B65H 11/00*** | (2006.01) |
| ***B41J 11/06*** | (2006.01) |

(52) U.S. Cl.

CPC ..... *B41J 11/0085* (2013.01); *B41J 11/06* (2013.01); *B65H 11/005* (2013.01); *B65H 5/222* (2013.01); *B65H 5/224* (2013.01); *B65H 2404/71* (2013.01)

(58) Field of Classification Search

CPC .... B65H 5/224; B65H 11/005; B41J 11/0085; B41J 11/06

See application file for complete search history.

(56) References Cited

U.S. PATENT DOCUMENTS

| | | | | |
|---|---|---|---|---|
| 3,652,075 | A * | 3/1972 | Thompson | B25B 11/005 269/21 |
| 4,312,694 | A * | 1/1982 | Sherman | G03B 27/20 156/286 |
| 5,865,433 | A | 2/1999 | Morrissette | |
| 6,371,430 | B1 | 4/2002 | Vernackt | |
| 6,474,805 | B2 | 11/2002 | Dante et al. | |
| 6,572,292 | B2 | 6/2003 | Kelley et al. | |
| 7,006,201 | B2 * | 2/2006 | Uemura | B41J 11/0085 269/21 |
| 7,775,475 | B2 * | 8/2010 | Tanaka | B29D 30/242 242/532.2 |
| 7,922,174 | B2 | 4/2011 | Panides et al. | |
| 7,988,150 | B2 * | 8/2011 | Harney | H04N 1/121 271/276 |
| 8,573,729 | B2 * | 11/2013 | Takamoto | B41J 11/06 347/101 |
| 9,073,354 | B2 * | 7/2015 | Ishimori | B41J 13/0009 |
| 9,950,546 | B2 * | 4/2018 | Sakai | B41J 3/28 |
| 9,975,357 | B2 * | 5/2018 | Suda | B41J 13/226 |
| 10,252,550 | B2 * | 4/2019 | Veis | B41J 13/0072 |

(Continued)

FOREIGN PATENT DOCUMENTS

| | | |
|---|---|---|
| CN | 201058525 | 5/2008 |
| CN | 102950914 | 3/2013 |

(Continued)

*Primary Examiner* — Howard J Sanders
(74) *Attorney, Agent, or Firm* — Steven R. Ormiston

(57) ABSTRACT

In an example, there is provided a method including: receiving, at a processor, data specifying the shape of a blank to form a folded article; and determining, using the processor, based on the received data, a suction array layout to hold the blank against a media support, wherein the suction array layout conforms to the shape of the blank.

10 Claims, 4 Drawing Sheets

(56) References Cited

U.S. PATENT DOCUMENTS

| | | | | |
|---|---|---|---|---|
| 2010/0213666 | A1 | 8/2010 | Harney et al. | |
| 2016/0176204 | A1* | 6/2016 | Dvori | B41J 13/226<br>347/104 |
| 2017/0057255 | A1* | 3/2017 | Byrne, III | B41J 11/0085 |

FOREIGN PATENT DOCUMENTS

| | | | | |
|---|---|---|---|---|
| CN | 103465638 | | 12/2013 | |
| CN | 104709515 | | 11/2016 | |
| DE | 10300235 | A1 * | 7/2004 | B26D 7/1863 |
| EP | 0765830 | | 4/1997 | |
| EP | 0799898 | | 10/1997 | |
| EP | 2561998 | | 8/2012 | |
| JP | 2005335246 | | 12/2005 | |
| JP | 2009107768 | | 5/2009 | |
| JP | 2015214386 | | 12/2015 | |

* cited by examiner

SUCTION ARRAY LAYOUTS

BACKGROUND

In printing, print agents such as inks or toners (generally, 'print agents') may be applied to a substrate. In some examples, the substrate will be held down using a vacuum platen during printing.

BRIEF DESCRIPTION OF DRAWINGS

Non-limiting examples will now be described with reference to the accompanying drawings, in which.

DETAILED DESCRIPTION

In some print apparatus, a pattern of print agent may be printed on a substrate by depositing print agents, such as inks, toners, coatings or the like, onto the substrate.

Figure 1:
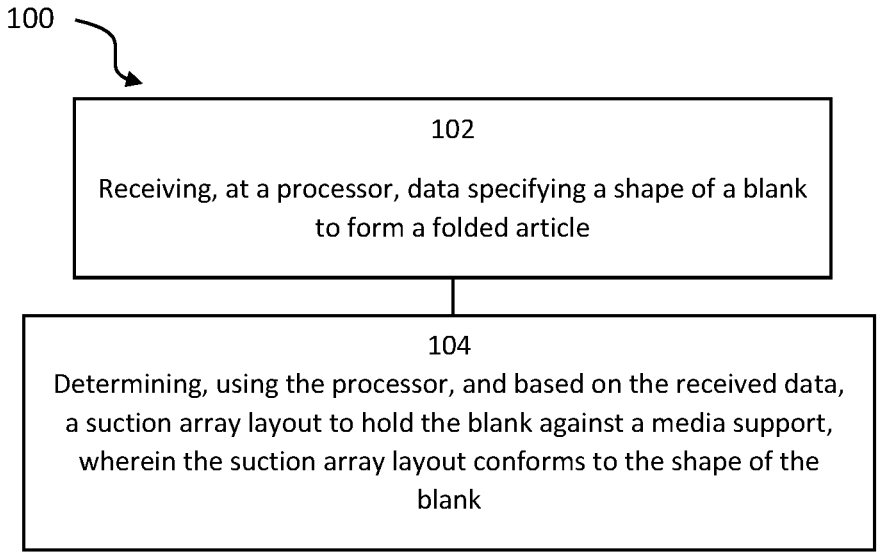
FIG. 1 is a schematic representation of an example method.

FIG. 1 shows an example of a method. The method comprises blocks 102 and 104.

Block 102 comprises receiving, at a processor, data specifying the shape of a blank to form a folded article.

Block 104 comprises determining, using a processor, based on the data, a suction array layout to hold the blank against a media support, wherein the suction array layout conforms to the shape of the blank.

The method of FIG. 1 may provide a suction array which is tailored to the particular shape of the blank, which may be a non-standard or bespoke shape. As the suction array conforms to the shape of the blank, the bank may be held down across its entire surface, particularly at its edges where cardboard blanks may be predisposed to lift up during printing, which may interfere with or prevent printing. Furthermore, if a different shape of blank is to be printed by the same printer, then a new suction array layout can be determined which corresponds to the shape of this different blank. Accordingly, the method may enable a single printer to efficiently print a range of different blanks.

Figure 2:
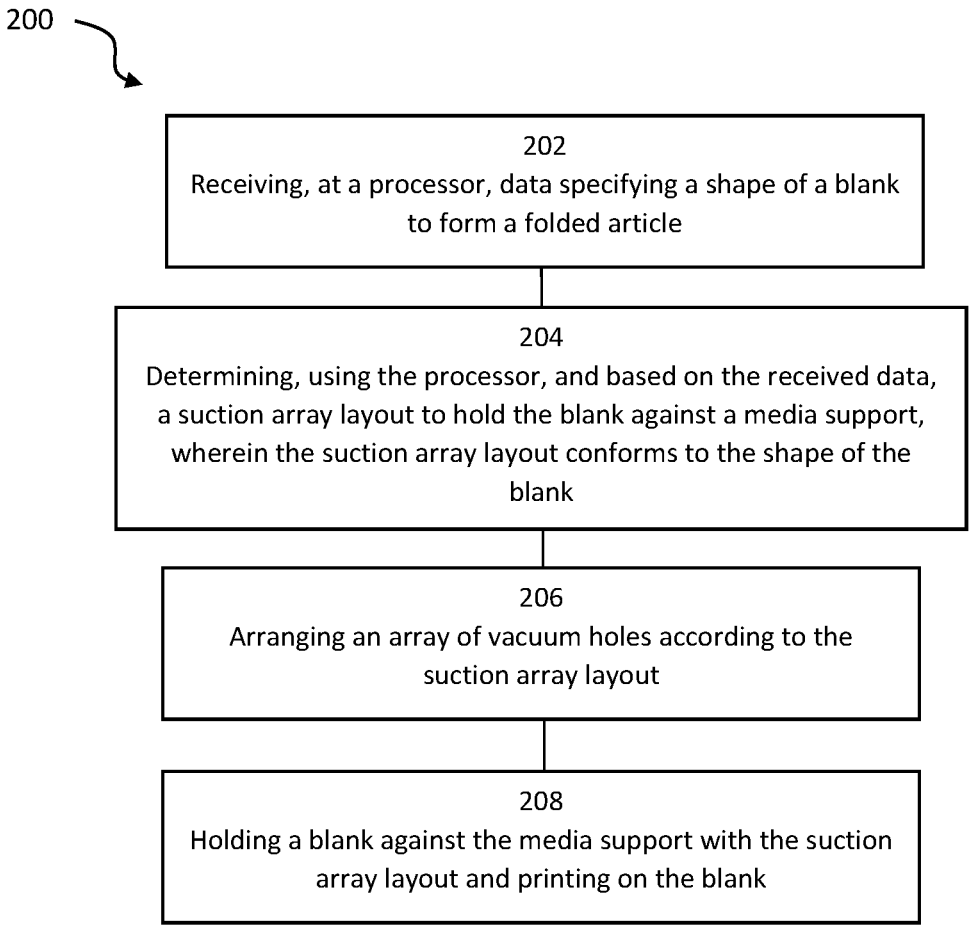
FIG. 2 is a further example of a method.

FIG. 2 shows a further example of a method. The method comprises blocks 202, 204, 206, 208.

Block 202 comprises receiving, at a processor, data specifying the shape of a blank to form a folded article. The shape of the blank may be predetermined. A total area of the blank may be smaller than an area available for the suction array, such as a vacuum platen.

Block 204 comprises determining, using a processor, based on the data, a suction array layout to hold the blank against a media support, wherein the suction array layout conforms to the shape of the blank. The suction array layout may comprise a plurality of vacuum holes. The vacuum holes of the suction array which correspond to locations within the shape of the blank may be operable vacuum holes. Non-operable vacuum holes may be present outside the shape of the blank. A sealing member may be provided to render vacuum holes outside the shape of the blank non-operable In this example, the shape of the blank comprises a plurality of segments and block 204 of determining the suction array comprises assigning at least one vacuum hole to each segment of the shape of the blank. The segments of the blank may form a side of a folded article, or a tab of a folded article. Folds or creases may be present between each segment of the blank. The blank, or each segment thereof may have a plurality of vacuum holes to apply suction to a periphery or edge of the blank or each segment thereof. The suction array may comprise a substantially equal spacing of the vacuum holes. In other examples, the vacuum holes may be more closely spaced in areas corresponding to a periphery or edge of the blank, or the segments thereof.

Block 206 comprises arranging an array of vacuum holes according to the suction array layout. The array of vacuum holes may be formed in the media support in order to form a vacuum platen. In some examples, there may be no other vacuum holes than those forming the suction array layout provided on the vacuum platen.

In some examples, block 206 may comprise forming a sealing sheet having an operative area corresponding to the shape of the blank within which the suction array layout is formed. The sealing sheet may be a layer of material which can be applied to a surface of the media support to close any vacuum holes which are arranged on the media support outside of the operative area. The sealing sheet may be formed of a flexible material. The sealing sheet may be print agent-resistant or repellent.

The sealing sheet may be formed from a plurality of separate sheets which in combination form a substantially continuous layer across the media support. In some examples, the sealing sheet may be formed from a mosaic of separate sheets.

The operative area of the sealing sheet may comprise holes or suction cups which correspond to vacuum holes of the media support. In some examples, some or all of the holes or suction cups of the sealing sheet may be aligned with the vacuum holes of the media support. In some examples, some or all of the holes or suction cups of the sealing sheet may be misaligned with the vacuum holes. In such examples, conduits or passages may be formed in the sealing sheet such that the holes or suction cups of the sealing sheet are in communication with the vacuum holes of the media support. The holes or suction cups of the sealing sheet may be located at locations corresponding to a perimeter or edge of the blank.

Block 206 may further comprise laying the sealing sheet onto media support to seal at least one vacuum hole. The vacuum hole or holes sealed may be outside the operative area. The sealing sheet may also seal vacuum holes within the operative area. The sealing sheet may seal all vacuum holes on the media support outside the operative area. Accordingly, a sealing sheet may permit the same media support to be used for printing multiple types of blanks by forming sealing sheets specific to each blank to be printed.

Block 208 comprises holding a blank against the media support with the suction array layout and printing on the blank. A suction array layout therefore may permit blanks having non-standard or complex shapes to be reliably held down without complex bespoke printing equipment.

In some examples, some or all of the blocks 202, 204, 206, 208 may be implemented remotely to a location of a print apparatus at which the array of vacuum holes will be utilised. In other examples, some or all of blocks 202, 204, 206, 208 may be implemented at a print apparatus at which the array will be utilised.

Figure 3:
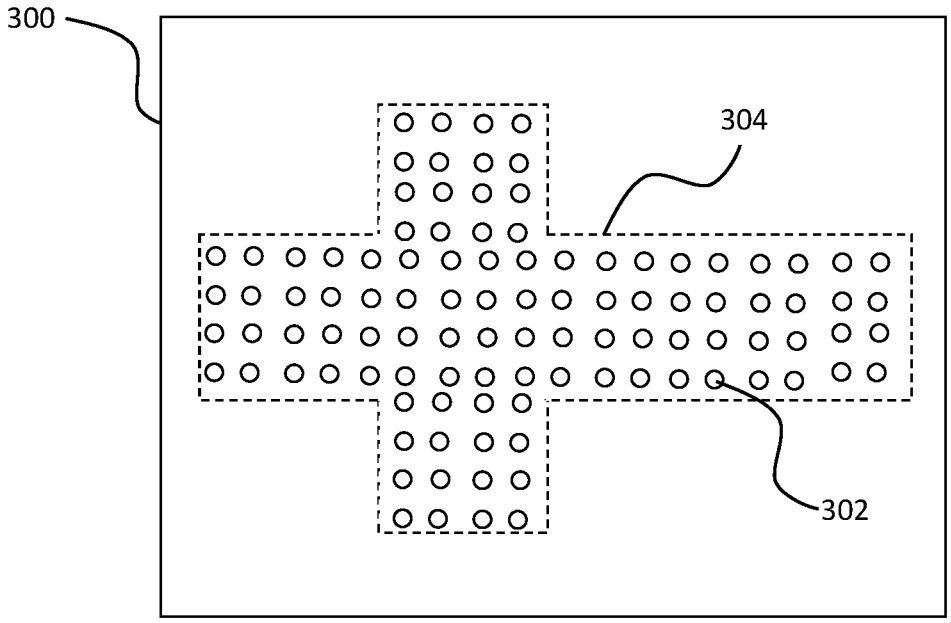
FIG. 3 is a schematic representation of an example vacuum platen.

FIG. 3 shows an example of a vacuum platen 300. The vacuum platen 300 comprises a plurality of operative suction holes 302. The operative suction holes 302 are distributed over an area 304 of the vacuum platen to be covered by a pre-fabricated blank. All of the operative suction holes 302 are disposed within the area 304.

When compared with other arrangements of vacuum platens, the vacuum platen 300 may provide a plurality of operative suction holes 302 which are arranged in a pattern which is tailored to the particular shape of a pre-fabricated blank. As the operative suction holes conform to the shape of the blank, the bank may be held down across its entire surface, particularly at its edges where cardboard blanks may be predisposed to lift up during printing, which may interfere with the printer heads. In addition, as operative suction holes may be provided exclusively in locations of the platen 300 which will be covered by a blank in use, a reduced amount of suction power may be lost or wasted through uncovered suction holes, which may improve the holding force applied to the blank by the operative suction holes and improve the efficiency of the platen.

Figure 4:
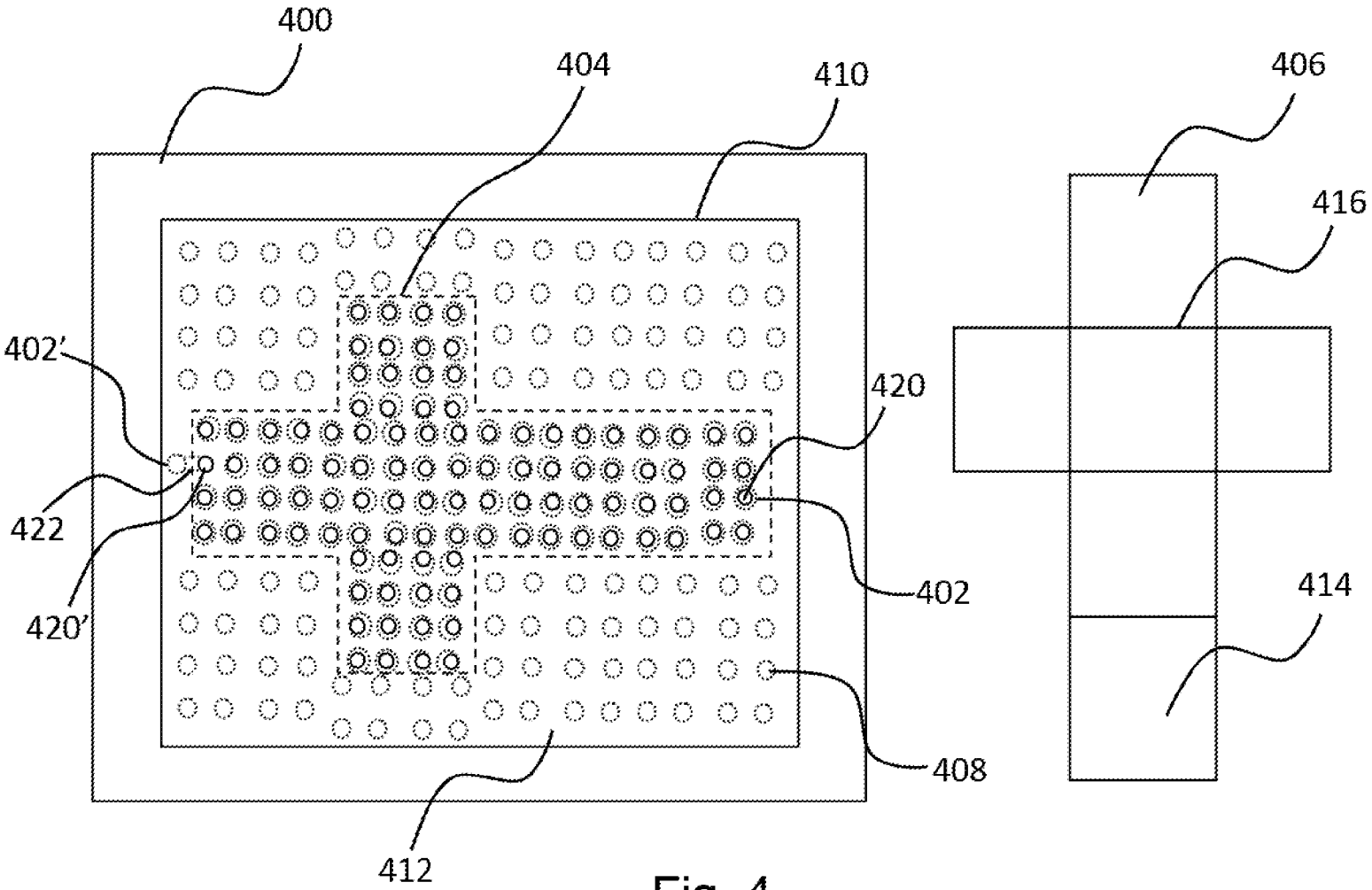
FIG. 4 is a further example of a vacuum platen.

FIG. 4 shows a further example of a vacuum platen 400. The vacuum platen 400 comprises a plurality of operative suction holes 402. The operative suction holes 402 are distributed over an area 404 of the vacuum platen to be covered by a pre-fabricated blank 406. All of the operative suction holes 402 may be disposed within the area 404.

In this example, the operative suction holes 402 are suction holes to which a vacuum source can be applied to thereby draw air through the suction hole to apply a holding force to a pre-fabricated blank. All of the operative suction holes 402 may be in communication with a single vacuum source, such as a vacuum chamber which extends beneath a surface area of the vacuum platen 400, which may be the area 404, or may be substantially the entire area of the vacuum platen 400. The area 404 may correspond to an operative area of the vacuum platen.

In this example, the vacuum platen 400 comprises a plurality of non-operative suction holes 408. The non-operative suction holes 408 are disposed outside the area 404. The area of the platen 400 outside the area 404 may be a non-operative area. In some other examples, no non-operative suction holes may be provided and all suction holes on the vacuum platen may be operative suction holes 402 within the area 404. In some examples, non-operative suction holes 408 may also be provided within the area 404. The non-operative suction holes 408 may be in communication with a vacuum source, but in this case they may be sealed to prevent air being drawn through the non-operative suction holes 408.

In this example, the non-operative suction holes 408 are sealed by a sealing member 410 to render them non-operative. In this example, the sealing member 410 may be a contiguous member which seals a plurality of non-operative suction holes. In some examples, a plurality of sealing members may be provided, each sealing member sealing some or all of the plurality of non-operative suction holes 408.

In order to hold a different blank on the vacuum platen 400, the sealing member 410 can be removed and a new sealing member can be applied to the vacuum platen having operative suction holes distributed over a different area which corresponds to the shape of the new blank. Accordingly, the method may enable a single vacuum platen to efficiently print a range of different blanks.

In this example, all of the non-operative suction holes 408 are sealed by a sealing sheet 410 having a non-operative area 412 which seals the non-operative suction holes 408 and an operative area which comprises holes or suction cups 420 in communication with the operative suction holes 402. The operative area of the sealing sheet 410 corresponds to the area 404 of the vacuum platen to be covered by the pre-fabricated blank 406. The sealing sheet 410 does not seal the operative suction holes 402 within the area 404 such that all suction holes within the area 404 are operative suction holes 402.

The holes or suction cups 420 formed in the sealing sheet 410 are in communication with respective operative suction holes 402 such that air may be drawn into the suction hole 402 through the hole or suction cup 420. The blank 406 may therefore be laid upon the sealing sheet in the area 404 and held down against the holes or suction cups 420. In some examples, suction cups 420 may be provided to conform to the surface of the blank 406 such that a better seal is formed with the blank to avoid vacuum leakage which may compromise the efficiency or effectiveness of the platen 400 in holding the blank 406 down during printing.

In this example, the majority of the holes or suction cups 420 of the sealing sheet 410 are substantially aligned with the operative suction holes 402 within the area 404. In some cases, the centres of the suction cup 420 and the suction hole 402 may not be exactly aligned.

However, in some examples, some holes or suction cups 420' of the sealing sheet 410 may be arranged differently to their respective operative suction holes 402'. In such examples, the holes or suction cups 420' of the sealing sheet 410 may be misaligned with operative suction holes 402' which may be outside the area 404 as shown in FIG. 4, or may be within the area 404. As the communication of operative suction hole 402' with the atmosphere is via the hole or suction cup 420' which is arranged within the area 404, it will be understood that operative suction hole 402' is notionally within the area 404.

In examples where a suction cup 420' is misaligned with an operative suction hole 402', a conduit or passage 422 may be formed in the sealing sheet 410 such that the holes or suction cup 420' of the sealing sheet 410 remain in communication with their respective operative suction hole 402' of the vacuum platen 400. Accordingly, even though the suction hole 402' is covered by the sealing sheet 410, it is not sealed as it is in communication with the atmosphere via the conduit 422 and the hole or suction cup 420'. It will be understood that some or all of the operative suction holes 402 may be misaligned with their respective holes or suction cups 420 in a similar manner and in communication via similar conduits or passages 422.

The holes or suction cups 420 of the sealing sheet 410 may be located at locations corresponding to a perimeter or edge of the blank. Holes or suction cups 420 may also be provided at other locations corresponding to areas within the perimeter of the blank. Each of the holes or suction cups 420 of the sealing sheet 410 may be in communication with one of the operative suction holes 402 or with a plurality of operative suction holes 402. In some cases, one hole or suction cup of the sealing sheet 410 may be in communication with two or three of the operative suction holes 402.

In other examples, the sealing sheet may seal some suction holes within the area 404 such that some non-operative suction holes 408 are provided in the area 404. The sealing sheet 410 may comprise a first sealing part which corresponds to the non-operative area 412 and a second operative part which corresponds to the area 404. The sealing sheet 410 may be formed from a plurality of separate sheets which may be arranged on the vacuum platen 400 to form a substantially continuous layer. The plurality of separate sheets may be mosaicked together on the surface of the vacuum platen 400.

The non-operative area 412 of the sealing sheet outside the area 404 may seal all other suction holes of the vacuum platen than the operative holes suction 402 within the area 404.

In other examples, the sealing sheet 410 may comprise an aperture which corresponds to the area 404 such that all suction holes 402 within the aperture are operative and not sealed by the sealing member 410.

The sealing sheet 410 may be a flexible or resiliently deformable sheet. The sealing sheet 410 may be ink-resistant or repellent. The sealing sheet 410 may be located and secured on the vacuum platen 400 with an adhesive or with a mechanical fixing, such as bolts. In some examples, the suction of the non-operative suction holes 408 may be sufficient to hold the sealing sheet 410 in place.

In this example, the pre-fabricated blank 406 comprises a plurality of segments 414. The segments 414 may be an area of the blank 406 which, once the blank 406 is folded and secured, forms a portion, such as a side, of a folded article, such as a box. Each of the segments 414 may form a tab for securing a folded article to be formed from the blank 406. The segments 414 of the blank 406 may have fold lines 416 formed therebetween to enable folding of the blank 406 at predetermined locations. The fold lines 416 may comprise crimping or heat-crimping of the blank 406, or scoring of the blank 406. The operative suction holes 402 may be arranged within the area 404 such that they are not provided locations directly below a fold line 416 when a blank 406 is placed over the area 404. In other examples, suction holes 402 may be located within the area 404 at locations corresponding to the fold lines 416 of the blank 406.

In this example, the blank 406 is pre-fabricated. The blank 406 may have been previously cut into a non-rectangular shape suitable to be formed into a folded article with no further cutting operations. In other examples, further cutting operations may be performed to form the blank into a folded article. The blank may comprise at least two segments 414 separated by a fold line 416. The blank 406 may be formable into a box or an envelope.

The blank 406 is formed from printable substrate. The blank 406 may be formed from paper, card, cardboard, plastic, or any combination thereof. The blank 406 may be formed of corrugated material. The blank 406 may have a thickness which is less than, more than, or substantially equal to a thickness of the sealing sheet 410.

Figure 5:
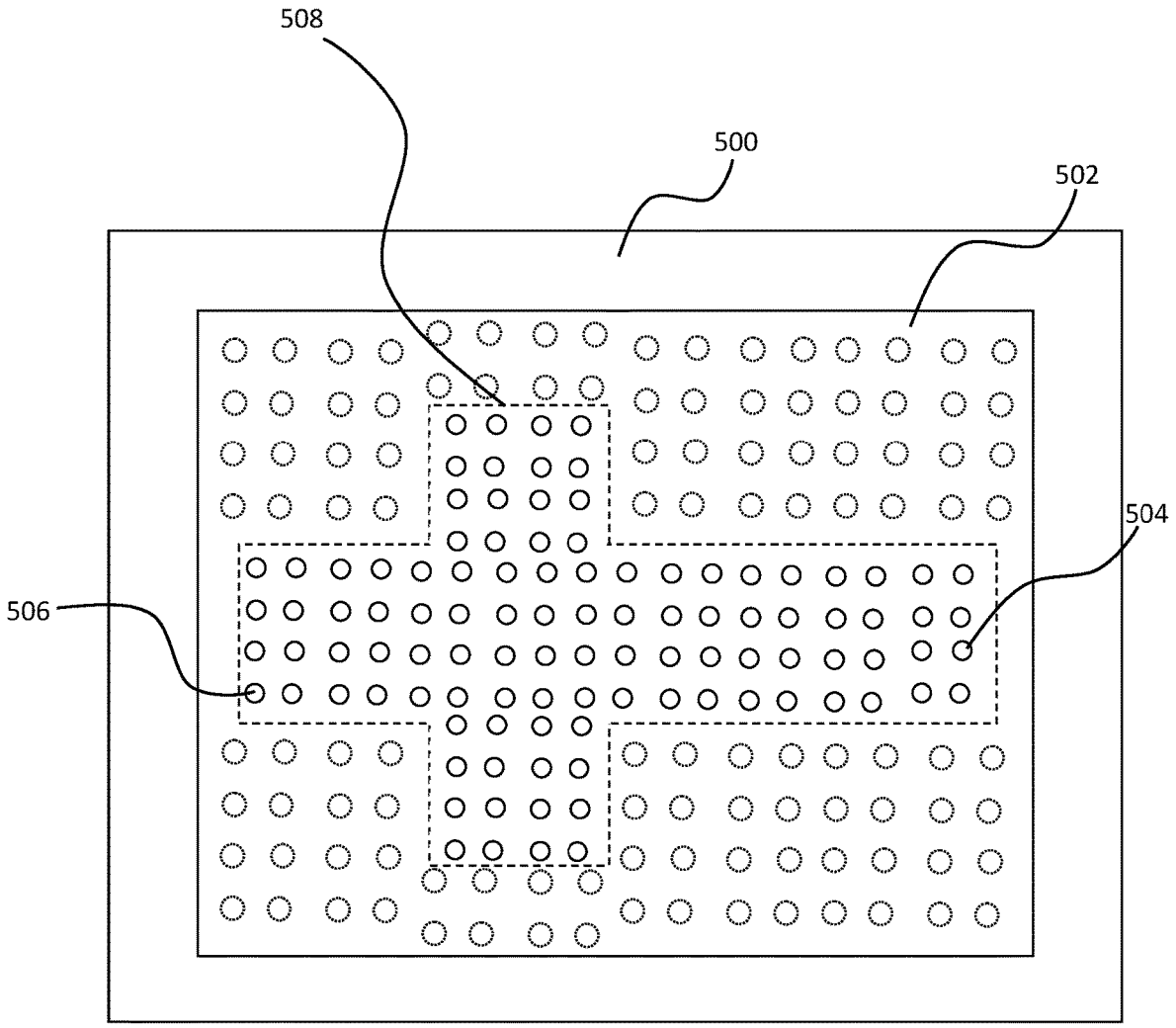
FIG. 5 is a schematic representation of an example print apparatus.

FIG. 5 shows an example of a print apparatus 500. The print apparatus 500 comprises a vacuum platen 502. The vacuum platen 502 comprises an array 504 of vacuum holes 506 formed over an operative area 508 of the vacuum platen 502. The operative area 508 has a shape corresponding to the shape of a pre-cut blank for forming a folded product.

In some examples, the vacuum platen may comprise an array of vacuum holes formed over a non-operative area of the vacuum platen. The vacuum holes in the non-operative area may be constructed as per the non-operative suction holes of FIG. 4.

In some examples, the print apparatus may further comprise a covering membrane which prevents operation of the array of vacuum holes within the non-operative area. The covering membrane may be constructed as per the sealing member or sealing sheet of FIG. 4.

In some examples, the vacuum platen 502 may comprise a non-operative area having no vacuum holes which substantially encircles the operative area.

In some examples, the vacuum platen 502 be constructed as per the vacuum platen of FIG. 3 or 4.

In some examples, the vacuum platen 502 may be a vacuum belt comprising a plurality of operative areas. The vacuum belt may be formed from a plurality of vacuum platens constructed according to FIG. 3 or 4. The vacuum belt may comprise a plurality of vacuum platens which are articulated relative to each other. The print apparatus 500 may comprise a belt drive for driving the vacuum belt.

The vacuum platen 502 may comprise a suction array layout as determined using the method of FIG. 1 or 2. The suction array layout may be formed across a plurality of segments of a vacuum belt or a moving virtual table.

The print apparatus 500 may comprise a print heads to apply print agents on to blanks which are held by the vacuum platen 502. The print apparatus 500 may also comprise a loading mechanism to locate a pre-cut blank on the vacuum platen on the area 508.

Aspects of some examples in the present disclosure can be provided as methods, systems, or machine readable instructions, such as any combination of software, hardware, firmware, or the like. Such machine readable instructions may be included on a computer readable storage medium (including but is not limited to disc storage, CD-ROM, optical storage, etc.) having computer readable program codes therein or thereon.

The present disclosure is described with reference to flow charts and block diagrams of the method, devices, and systems according to examples of the present disclosure. Although the flow diagrams described above show a specific order of execution, the order of execution may differ from that which is depicted. Blocks described in relation to one flow chart may be combined with those of another flow chart. It shall be understood that at least one flow in the flow charts, as well as combinations of the flows in the flow charts can be realized by machine readable instructions.

The machine readable instructions may, for example, be executed by a general purpose computer, a special purpose computer, an embedded processor or processors of other programmable data processing devices to realize the functions described in the description and diagrams, Thus functional modules of the apparatus and devices may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

While the method, apparatus, and related aspects have been described with reference to certain examples, various modifications, changes, omissions, and substitutions can be made without departing from the spirit of the present disclosure. It is intended, therefore, that the method, apparatus, and related aspects be limited only by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. An apparatus for a printer comprising:

a vacuum platen having multiple suction holes therein and a sealing sheet on the platen over an area that includes all of the suction holes in the platen, the sealing sheet comprising:

a first part defining an operative area of the platen to be covered by a pre-fabricated blank for printing, the first part of the sheet having:

multiple first holes therein each substantially aligned with a suction hole in the platen such that the sheet covers some but not all of the suction holes in the operative area of the platen;

multiple second holes therein each not substantially aligned with a suction hole in the platen; and a passage from each of the second holes to a suction hole in the platen; and a second part defining a non-operative area of the platen, the second part of the sheet covering all of the suction holes in the non-operative area of the platen.

2. An apparatus as claimed in claim 1, wherein at least some of the holes in the first part of the sheet comprise suction cups.

3. An apparatus as claimed in claim 1, wherein the sheet comprises a flexible sheet.

4. An apparatus as claimed in claim 1, wherein the passages from the second holes to suction holes in the platen include a passage from one or more of the second holes to a corresponding one or more of the suction holes in the non-operative area of the platen.

5. An apparatus as claimed in claim 1, wherein the passages from the second holes to suction holes in the platen include a passage from one or more of the second holes to a corresponding one or more of the suction holes in the operative area of the platen.

6. An article for a printer vacuum platen having suction holes, the article comprising a sheet to extend over an area that includes all of the suction holes in the platen, the sheet comprising:

a first part configured to, when the sheet is placed on the platen, define an operative area of the platen to be covered by a pre-fabricated blank for printing, the first part of the sheet having:

multiple first holes therein each substantially aligned with a suction hole in the operative area of the platen such that the sheet covers some but not all of the suction holes in the operative area of the platen;

multiple second holes therein each not substantially aligned with a suction hole in the platen; and a passage from each of the second holes to a suction hole in the platen; and a second part configured to, when the sheet is placed on the platen, define a non-operative area of the platen and cover all of the suction holes in the non-operative area of the platen.

7. An article as claimed in claim 6, wherein at least some of the holes in the first part of the sheet comprise suction cups.

8. An article as claimed in claim 6, wherein the sheet comprises a flexible sheet.

9. An article as claimed in claim 6, wherein the passages from the second holes to suction holes in the platen include a passage from one or more of the second holes to a corresponding one or more of the suction holes in the non-operative area of the platen.

10. An article as claimed in claim 6, wherein the passages from the second holes to suction holes in the platen include a passage from one or more of the second holes to a corresponding one or more of the suction holes in the operative area of the platen.

* * * * *